US010066362B2

(12) United States Patent
Ledet et al.

(10) Patent No.: US 10,066,362 B2
(45) Date of Patent: Sep. 4, 2018

(54) PIPE TRENCHING

(71) Applicants: Wayne Ledet, Houma, LA (US); Paul Oliver, Saline, LA (US)

(72) Inventors: Wayne Ledet, Houma, LA (US); Paul Oliver, Saline, LA (US)

(73) Assignee: L. L. & G. Construction, Inc., Houma, LA (US)

( * ) Notice: Subject to any disclaimer, the term of this patent is extended or adjusted under 35 U.S.C. 154(b) by 0 days.

(21) Appl. No.: 15/430,466

(22) Filed: Feb. 11, 2017

(65) Prior Publication Data

US 2017/0233980 A1 Aug. 17, 2017

Related U.S. Application Data

(60) Provisional application No. 62/294,376, filed on Feb. 12, 2016.

(51) Int. Cl.
*E02F 5/10* (2006.01)

(52) U.S. Cl.
CPC ..... *E02F 5/107* (2013.01); *E02F 5/109* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,004,392 | A | 10/1961 | Symmank | |
| 3,732,701 | A | 5/1973 | Lynch | |
| 4,037,422 | A * | 7/1977 | DEBoer | E02F 5/104 405/160 |
| 4,154,551 | A | 5/1979 | Petrie | |
| 4,274,760 | A | 6/1981 | Norman | |
| 4,516,880 | A | 5/1985 | Martin | |
| 4,586,850 | A | 5/1986 | Norman et al. | |
| 4,714,378 | A | 12/1987 | Lincoln | |
| 5,288,172 | A | 2/1994 | Reuhl | |
| 2012/0121339 | A1 * | 5/2012 | Lazzarin | E02F 5/04 405/159 |

OTHER PUBLICATIONS

International Search Report and Written Opinion from related patent application PCT/US17/17580, dated May 1, 2017.

* cited by examiner

*Primary Examiner* — Kyle Armstrong
(74) *Attorney, Agent, or Firm* — John B. Edel; Edel Patents LLC

(57) ABSTRACT

Pipe burial apparatus are disclosed that include sets of rotary nozzle cutters configured to straddle a pipe that is to be buried and a nozzle array connected to a nozzle supply pipe in a manner that places the nozzle supply pipe in a cutting path of a rotary nozzle cutter. The nozzle supply pipe may be actuated to alternatingly move the nozzle array between a position straddling the pipe being buried and a cutting position that is below the pipe being buried.

13 Claims, 5 Drawing Sheets

PIPE TRENCHING

Pipe burying apparatus described herein may be used in the burying of pipe on the seafloor. Certain pipe burying apparatus disclosed herein may be useful for burying large diameter pipeline.

DETAILED DESCRIPTION

Example 1

Figure 1:
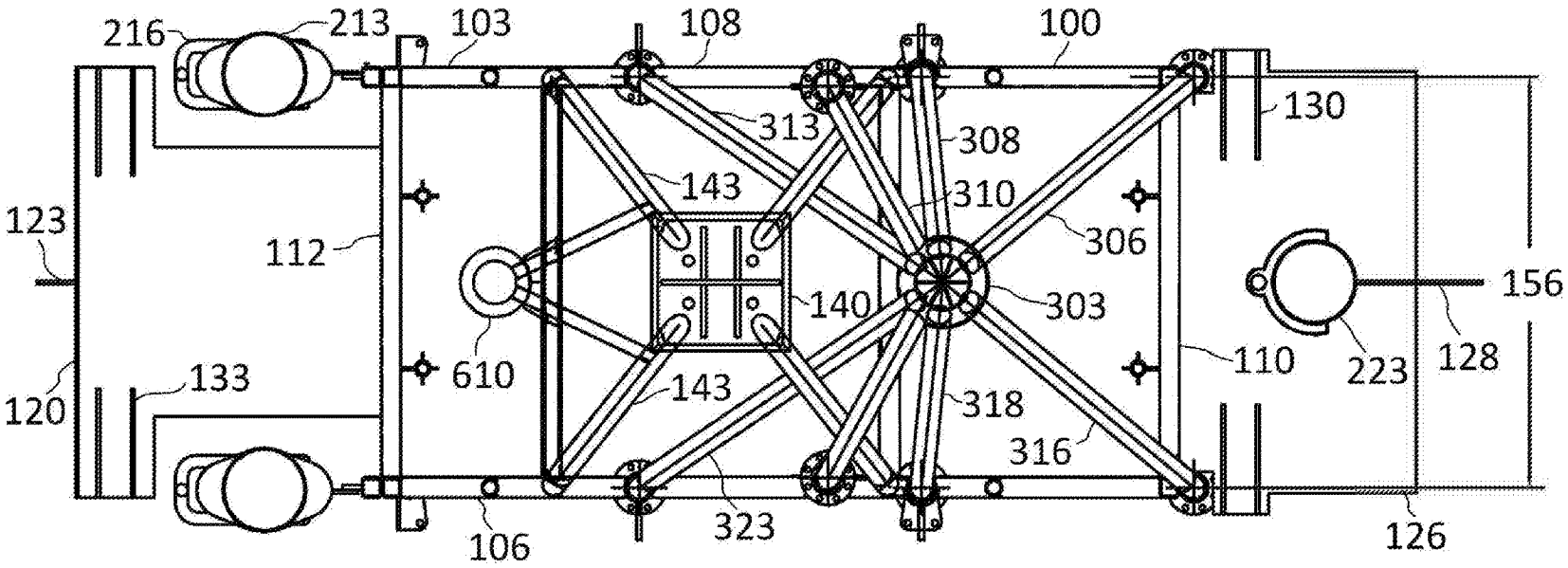
FIG. 1 shows a plan view of the pipe burying apparatus.

FIG. 1 of the drawings is a plan view of the Pipe burying apparatus. Depicted in FIG. 1 are Pipe burying apparatus 100, Frame 103, Top right frame member 106, Top left frame member 108, Top forward frame member 110, Top rear frame member 113, Rear frame structure 120, Rear pad eye 123, Forward frame structure 126, Forward pad eye 128, Forward buoyancy tank mounting plates 130, Rear buoyancy tank mounting plates 133, Front eductor hood 136, Lifting pad eye 140, Lifting location supports 143, Cutter attachment flange spread 156, Rear eductors 213, Eductor air supply 216, Forward eductor 223, Cutting water distribution manifold 303, First distribution pipe 306, Second distribution pipe 308, Third distribution pipe 310, Fourth distribution pipe 313, Fifth distribution pipe 316, Sixth distribution pipe 318, Seventh distribution pipe 320, Eighth distribution pipe 323 and Air manifold 610.

Figure 2:
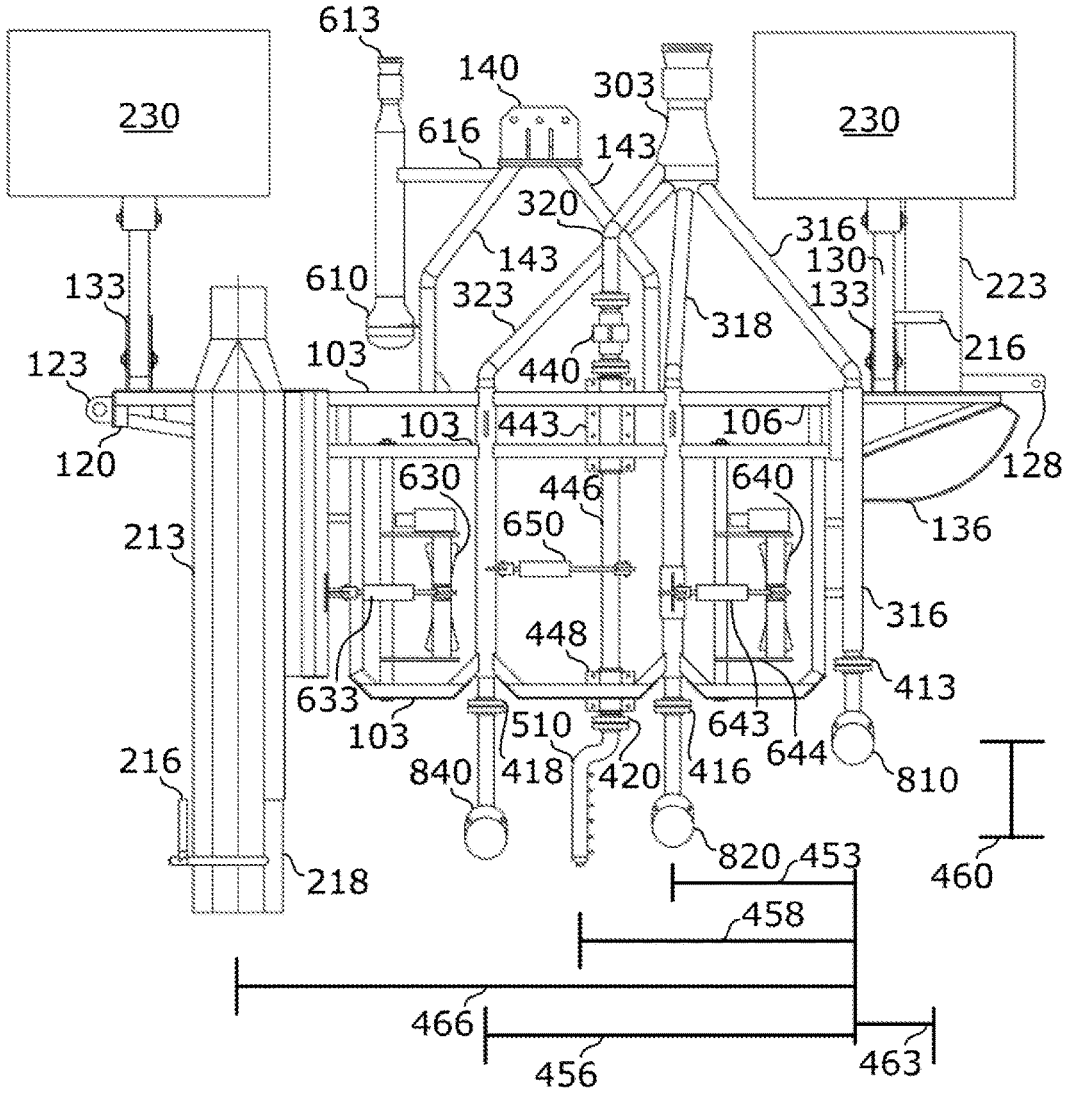
FIG. 2 shows a side elevation view of the pipe burying apparatus.

FIG. 2 is a side elevation view of the pipe burying apparatus. Further depicted in FIG. 2 are Rear eductors 213, Eductor air supply 216, Rear eductor suction end 218, Forward eductor 223, Buoyancy tanks 230, Forward rotating cutter attachment flange 413, Middle rotating cutter attachment flange 416, Rear rotating cutter attachment flange 418, Ridge busting attachment flange 420, Swivel joint 440, Upper rotating pipe collar 443, Rotating pipe 446, Lower rotating pipe collar 448, Middle rotating cutter setback 453, Rear rotating cutter setback 456, Ridge busting attachment flange setback 458, Front eductor lead distance 463, Rotating cutter vertical span 460, Rear eductor setback 466, Ridge busting pipe 510, Air manifold 610, Air manifold connection 613, Air manifold support bracket 616, Rear pipe roller 630, Rear pipe roller actuating rain 633, Forward pipe roller 640, Forward pipe roller actuating ram 643, Roller door 644, Rotating pipe actuating ram 650, First rotating cutter set 810, Second rotating cutter set 820 and Third rotating cutter set 840.

Pipe burying apparatus 100 may be assembled with a Frame 103 having a Top right frame member 106, a Top left frame member 108, a Top forward frame member 110, a Top rear frame member 113, a Rear frame structure 120 having Rear pad eye 123 and a variety of other structural components such as depicted in the figures. Forward frame structure 126 may have a Forward pad eye 128 which may be used to guide Pipe burying apparatus 100 into position such that Pipe burying apparatus 100 may grasp the pipe to be buried and begin a burial operation. Forward buoyancy tank mounting plates 130, Rear buoyancy tank mounting plates 133 and other buoyancy tank support structures may be used to mount Buoyancy tanks 230 such that Pipe burying apparatus 100 is maintained with proper weight balance and buoyancy. Pipe burying apparatus 100 is configured to travel forward along a pipe to be buried such that Front eductor hood 136 removes an initial quantity of Earth adjacent to the pipe including already loose material and material cut by First rotating cutter set 810. Forward eductor 223 provides suction by way of Eductor air supply 216 to remove material from below Front eductor hood 136. Lifting pad eye 140 is connected to Frame 103 by Lifting location supports 143 and facilitates the raising, lowering and guiding of Pipe burying apparatus 100. Rear eductors 213 remove a portion of the remaining material cut by Second rotating cutter set 820, Third rotating cutter set 840 and Ridge busting pipe 510, providing a trench for the pipe to occupy. Cutting water distribution manifold 303 provides water to the cutting nozzles by way of First distribution pipe 306, Third distribution pipe 310, Fourth distribution pipe 313, Fifth distribution pipe 316, Sixth distribution pipe 318, Seventh distribution pipe 320 and Eighth distribution pipe 323. Forward rotating cutter attachment flange 413, Middle rotating cutter attachment flange 416, Rear rotating cutter attachment flange 418 and Ridge busting attachment flange 420 serve as the attachment points for the various cutting tools which may be attached in a variety of configurations depending on the type of material being cut and the size of the pipe, among other factors. Ridge busting pipe 510 is configured to remove material directly under the pipe being buried such that it cuts seafloor and moves materials that are difficult to reach with the rotating cutters that are not positioned beneath the pipe. Swivel joint 440 allows Ridge busting pipe 510 to swing beneath Grasped pipe 710 (see FIG. 4) when Pipe burying apparatus 100 is locked on to Grasped pipe 710 with Rear pipe roller 630 and Forward pipe roller 640. Below Swivel joint 440, Rotating pipe 446 is able to rotate within Upper rotating pipe collar 443 and Lower rotating pipe collar 448 allowing Ridge busting pipe 510 to swing into place beneath the pipe being buried. Swivel joint 440 may be a high pressure swivel joint and may be a ball bearing type high pressure swivel joint. Ridge busting pipe 510 may be configured to rotate 90° or 180° and in most cases will be capable of rotating greater than 45°. Pneumatically controlled Rotating pipe actuating rain 650 actuates Ridge busting pipe 510 in and out of the cutting position. Along the length of Pipe burying apparatus 100 the centerline of First rotating cutter set 810 is set off from the centerline of Forward eductor 223 by a Front eductor lead distance 463. As depicted in FIG. 2 the various cutters are set back from First rotating cutter set 810 by a Middle rotating cutter setback 453, a Rear rotating cutter setback 456, and a Ridge busting attachment flange setback 458. The cutting position of Ridge busting pipe 510 may be at the Ridge busting attachment flange setback 458, but when Pipe burying apparatus 100 is mounting the pipe to be buried, Ridge busting pipe 510 may be positioned in alignment with and between Second rotating cutter set 820 and Third rotating cutter set 840. Ridge busting attachment flange setback 458 may be between 3.0 and 6.0 feet. Middle rotating cutter setback 453 may be between 2.0 and 4.0 feet. Rear rotating cutter setback 456 may be between 4.0 and 9.0 feet. Air manifold 610 is supplied from Air manifold connection 613 and ultimately supplies air to the eductors. Rear pipe roller 630 is attached by hinge to Frame 103 by Roller door 644 and actuated to grip Grasped pipe 710 by Rear pipe roller actuating rain 633. Forward pipe roller 640 and Forward pipe roller actuating rain 643 are similarly configured to grip Grasped pipe 710. Forward pipe roller 640 and Rear pipe roller 630 may further be driven by motors to move Pipe burying apparatus 100 down Grasped pipe 710.

Roller door 644 may be connected by hinges to Frame 103 and act with the assistance of Forward pipe roller actuating rain 643 to press Forward pipe roller 640 against the pipe securing the pipe within Pipe burying apparatus 100. The pipe rollers may be constructed of neoprene, polyurethane, or other suitable materials for gripping the pipe and moving Pipe burying apparatus 100 along the pipe during cutting. The movement along the pipe is such that First rotating cutter set 810 is on the leading edge of the cutting operation. Rotating cutter vertical span 460 represents the vertical separation between the first row of rotating cutters and the last row of rotating cutters and may be a variety of heights depending on the size of pipe being buried.

Rear eductors 213 and Forward eductor 223 may have vertical stacks of significant height attached to the tops of those elements to create an upward current of fluid, loose material and cuttings from the cutting area through the addition of air by way of Eductor air supply 216 which serves as the motive force for creating that current.

Figure 3A:
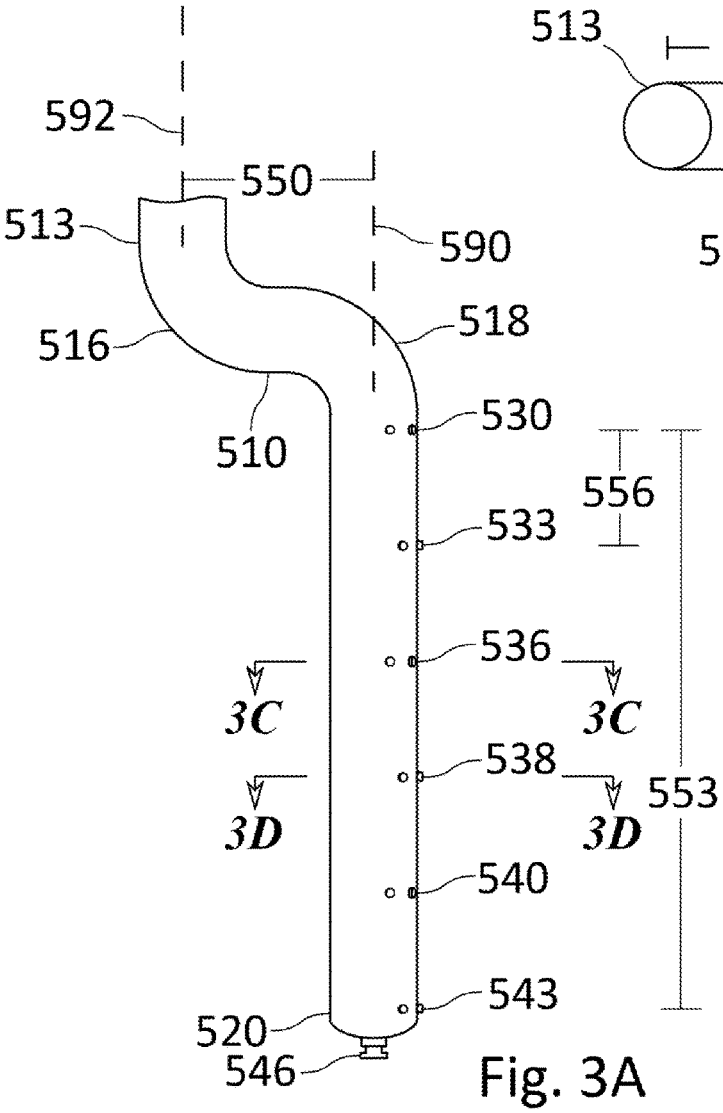
FIG. 3A shows an elevation view of the ridge busting pipe.

FIG. 3A is an elevation view of the ridge busting pipe. FIG. 3A depicts Ridge busting pipe 510 as it would be viewed from the front of Pipe burying apparatus 100 during trenching operations. Depicted in FIG. 3A are Ridge busting pipe 510, Ridge busting pipe upper vertical section 513, Ridge busting pipe upper elbow 516, Ridge busting pipe lower elbow 518, Ridge busting pipe lower vertical section 520, First nozzle row 530, Second nozzle row 533, Third nozzle row 536, Fourth nozzle row 538, Fifth nozzle row 540, Sixth nozzle row 543, Cleanout port 546, and Ridge busting pipe vertical axis separation distance 550, which is the distance between the Lower vertical section central axis 590 and Upper vertical section central axis 592. Ridge busting pipe vertical axis separation distance 550 may be greater than 8 inches and in certain embodiments having larger pipe diameters it may be greater than 12 inches. Full nozzle height 553 represents the total nozzle height on Ridge busting pipe 510 and Nozzle separation distance 556 represents the separation between nozzle rows.

Figure 3B:
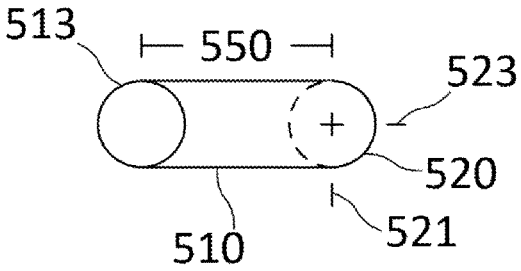
FIG. 3B shows a plan view of the ridge busting pipe.

FIG. 3B is a plan view of the ridge busting pipe. Depicted in FIG. 3B are Ridge busting pipe 510, Ridge busting pipe upper vertical section 513, Ridge busting pipe lower vertical section 520, 0° Angle 521, 90° Nozzle Angle 523 and Ridge busting pipe vertical axis separation distance 550. Further, FIG. 3B and particularly 0° Angle 521 and 90° Nozzle Angle 523 provide a frame of reference for later described nozzle angles.

Figure 3C:
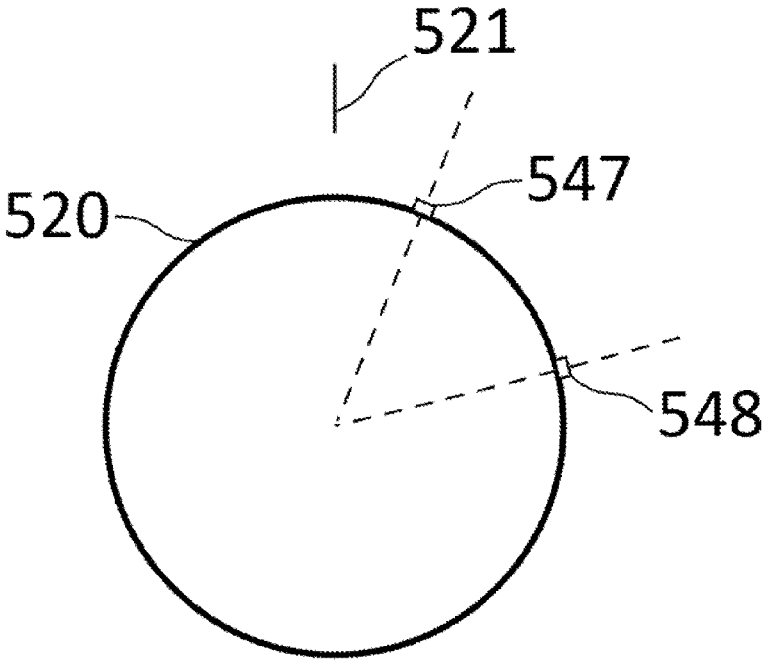
FIG. 3C shows a section view of the ridge busting pipe.
Figure 3D:
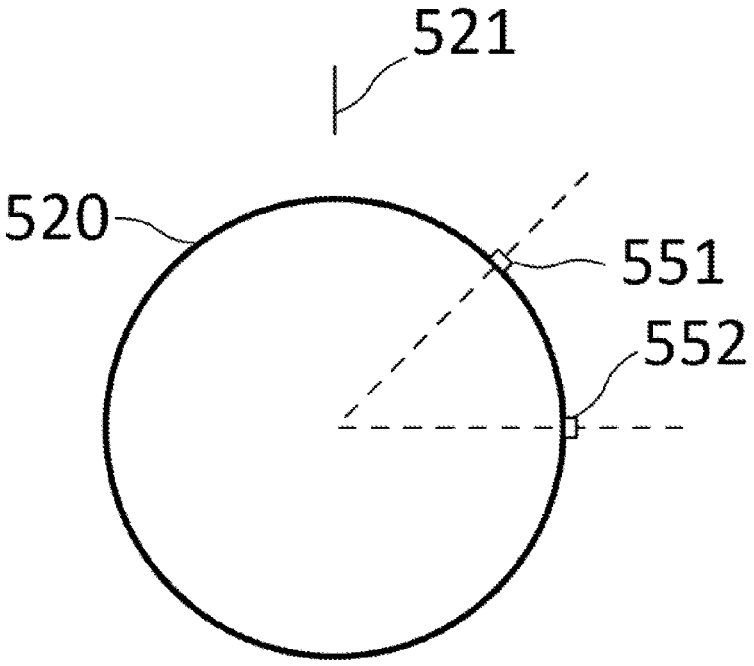
FIG. 3D shows a section view of the ridge busting pipe.

FIGS. 3C and 3D are cross-section views of Ridge busting pipe 510. The positions of nozzles on First nozzle row 530, Third nozzle row 536 and Fifth nozzle row 540 are depicted in FIG. 3C and the positions of nozzles on Second nozzle row 533, Fourth nozzle row 538 and Sixth nozzle row 543 are depicted in FIG. 3D. FIGS. 3C and 3D also depict 0° Angle 521 as a frame of reference for nozzle placement.

FIG. 3B is used as a frame of reference for the location of individual nozzles around the perimeter of Ridge busting pipe 510 with 0° Angle 521 being perpendicular to the plane connecting Lower vertical section central axis 590 and Upper vertical section central axis 592. Referring now to FIG. 3C Nozzle position 547 is at 22° around Ridge busting pipe lower vertical section 520 relative to 0° Angle 521 and Nozzle position 548 is at 76° around Ridge busting pipe lower vertical section 520 relative to 0° Angle 521. Nozzle position 547 and Nozzle position 548 may both be configured such that the nozzles aim away from Ridge busting pipe lower vertical section 520 horizontally. Referring now to FIG. 3D Nozzle position 551 is at 45° around Ridge busting pipe lower vertical section 520 relative to 0° Angle 521 and Nozzle position 552 is at 90° around Ridge busting pipe lower vertical section 520 relative to 0° Angle 521. Nozzle position 551 and Nozzle position 552 may both be configured such that the nozzles aim away from Ridge busting pipe lower vertical section 520 with a slight downward angle of 5° below horizontal.

Figure 4:
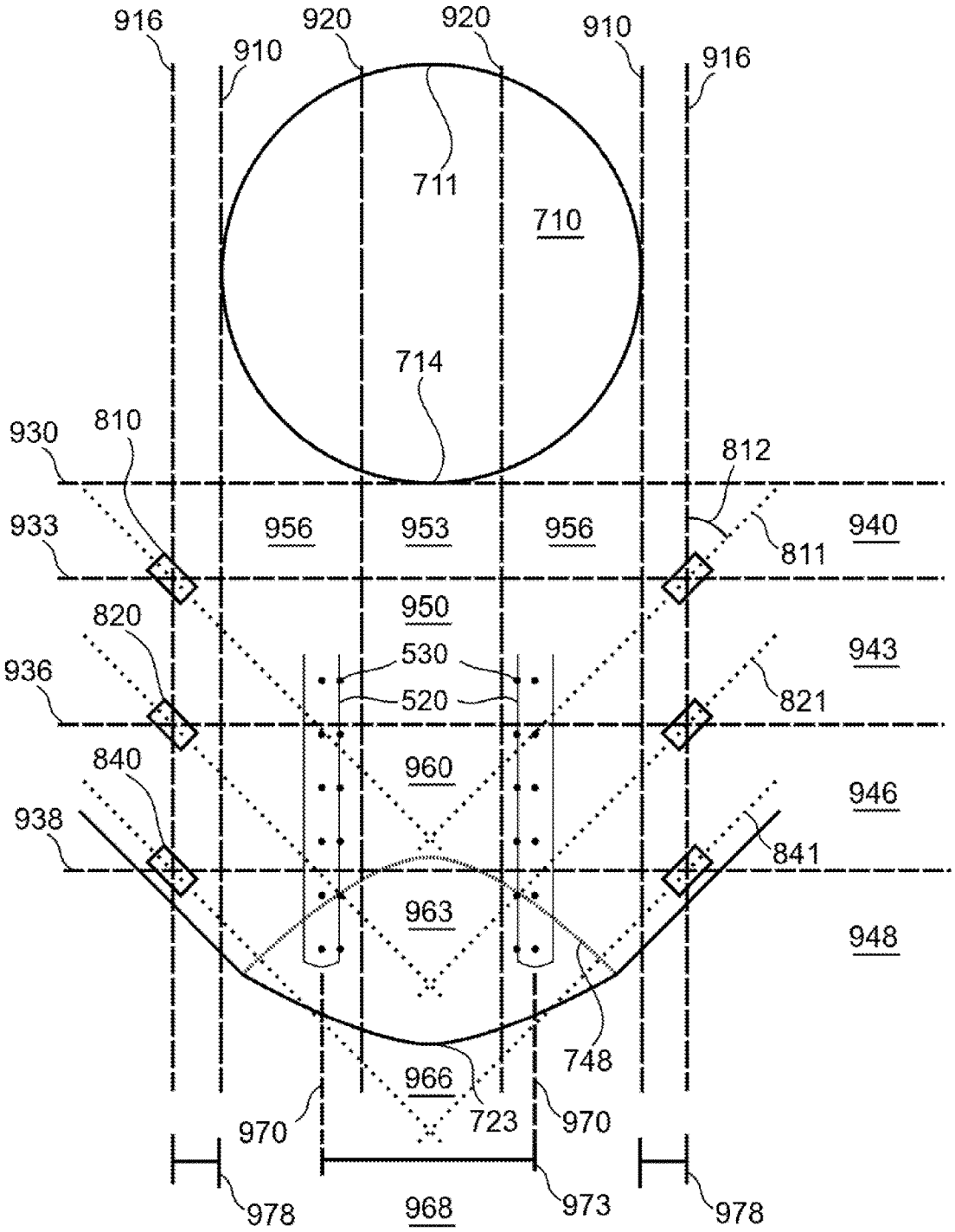
FIG. 4 shows a partial elevation view of the pipe burying apparatus from the front of the pipe burying apparatus.

FIG. 4 shows a partial elevation view of the pipe burying apparatus from the front of the pipe burying apparatus with certain details removed to better show certain spacial relationships. Depicted in FIG. 4 are Ridge busting pipe lower vertical section 520, First nozzle row 530, Grasped pipe 710, Pipe top 711, Pipe bottom 714, Trench bottom 723, Trench Ridge 748, First rotating cutter set 810, First rotating cutter set rotation planes 811, Rotating cutter angle 812, Second rotating cutter set 820, Second rotating cutter set rotation planes 821, Third rotating cutter set 840, Third rotating cutter set rotation planes 841, Vertical pipe edge planes 910, Rotating cutter location vertical planes 916, Vertical one third diameter dividing planes 920, Horizontal pipe bottom plane 930, Horizontal first rotating cutter set plane 933, Horizontal second rotating cutter set plane 936, Horizontal third rotating cutter set plane 938, Immediate sub pipe level 940, First sub rotating cutter level 943, Second sub rotating cutter level 946, Third sub rotating cutter level 948, Sub pipe space 950, Middle third sub pipe space 953, Outer third sub pipe spaces 956, Top slice space 960, Upper middle slice space 963, Lower middle slice space 966, Bottom slice space 968, Ridge busting pipe central axis 970, Ridge busting pipe central axis separation distance 973 and Rotating cutter setback 978.

Ridge busting pipe lower vertical section 520 is positioned directly below Grasped pipe 710 during cutting such that it is in an ideal position to clear material from the center of the trench being cut. The use of rotating cutters adjacent to the area below Grasped pipe 710 may be ineffective in removing materials in the vicinity of the center of the trench when Grasped pipe 710 has an outer diameter of 24 inches or greater thus leading to the creation of Trench Ridge 748. Ridge busting pipe lower vertical section 520 is particularly effective at breaking up or cutting Trench Ridge 748 for removal by the eductors. Sub pipe space 950, being the space below Grasped pipe 710, is of particular interest when dealing with pipes of larger diameter. Various embodiments of Pipe burying apparatus 100, as described herein may be used for pipes having an outer diameter of 24 inches or larger and certain embodiments may be configured to bury pipe that has a 36 inch or larger outer diameter. Sub pipe space 950 may be divided into three sections of equal length namely a Middle third sub pipe space 953 and two Outer third sub pipe spaces 956. Ridge busting pipe 510 may be located in the Outer third sub pipe spaces 956 and have nozzle arrangements particularly focused on removing material from the Middle third sub pipe space 953. Middle third sub pipe space 953 is separated from Outer third sub pipe spaces 956 by Vertical one third diameter dividing planes 920. The various levels below Pipe bottom 714 may be identified with the aid of a number of planes including: Horizontal pipe bottom plane 930, Horizontal first rotating cutter set plane 933, Horizontal second rotating cutter set plane 936 and Horizontal third rotating cutter set plane 938 which may divide Sub pipe space 950 and the space outside of Sub pipe space 950 into a variety of levels. Sub pipe space 950 is bounded by Vertical pipe edge planes 910. The horizontal cutter set planes are identifiable by passing through the centers of First rotating cutter set 810, Second rotating cutter set 820 and Third rotating cutter set 840. As Pipe burying apparatus 100 is being deployed and positioned, all of the cutting equipment may be roughly in alignment with Rotating cutter location vertical planes 916 which pass through First rotating cutter set 810, Second rotating cutter set 820 and Third rotating cutter set 840 so that Grasped pipe 710 may pass through the space between the cutters to be gripped by the rollers. Immediate sub pipe level 940 may be without any cutters in Sub pipe space 950, however each of First sub rotating cutter level 943, Second sub rotating cutter level 946 and Third sub rotating cutter level 948 may contain one or more nozzles or one or more rows of nozzles on Ridge busting pipe lower vertical section 520. The nozzles or rows of nozzles may be located in Outer third sub pipe spaces 956 with some or all of those nozzles being oriented toward Middle third sub pipe space 953. In an alternate embodiment, the nozzles or rows of nozzles may be located in Middle third sub pipe space 953 and may have spray directed to one or more of Middle third sub pipe space 953 and Outer third sub pipe spaces 956. Pipe top 711 may be buried at a depth of greater than 0.75 in measured from the original seafloor to Pipe top 711. The burial may be such that Pipe bottom 714 lies on Trench bottom 723. First rotating cutter set rotation planes 811 may be set at Rotating cutter angle 812, which may vary depending on the diameter of pipe being buried and the desired burial depth. Similarly, Second rotating cutter set 820 would have Second rotating cutter set rotation planes 821 and Third rotating cutter set 840 would have Third rotating cutter set rotation planes 841. The cutter set rotation planes are perpendicular to the rotation axis of the cutters and pass through the middle of the cutters. First rotating cutter set rotation planes 811, Second rotating cutter set rotation planes 821 and Third rotating cutter set rotation planes 841 may further be used to define "V" shaped slices cut by the rotating cutters, namely Top slice space 960, Upper middle slice space 963, Lower middle slice space 966 and Bottom slice space 968. Positioning individual nozzles or rows of nozzles in one or more of Top slice space 960, Upper middle slice space 963 and/or Lower middle slice space 966 may provide particular advantages in the removal of materials in Sub pipe space 950 generally and Middle third sub pipe space 953 particularly. The location of Ridge busting pipe central axis 970 may pivot depending on the particular embodiments selected from Rotating cutter location vertical planes 916 to either Middle third sub pipe space 953 or Outer third sub pipe spaces 956. Ridge busting pipe central axis separation distance 973 may be greater than one third the diameter of Grasped pipe 710 or it may be less than one third the diameter of Grasped pipe 710, but in most embodiments it will be less than two thirds the diameter of Grasped pipe 710 during cutting operations. Ridge busting pipe central axis separation distance 973 may be between 0.5 and 3.0 feet or may be between 1.0 and 2.5 feet. Rotating cutter setback 978 may be less than one third the diameter of Grasped pipe 710 and may be selected to be the smallest practical distance suitable for positioning Grasped pipe 710 for burial. Rotating cutter location vertical planes 916 may be separated by 3 feet or more and in some cases may be separated by 4 feet or more.

The positioning of nozzles may vary based on the diameter of pipe that is being buried and the nature of the seafloor that the pipe is being buried in. Pipe diameters that may be particularly suited for burying with embodiments disclosed herein include pipes greater than 24 inches and in many examples pipes greater than 36 inches.

Ridge busting pipe lower vertical section 520 may be rotated by 90° to position the nozzles for cutting underneath the pipe. The axis of rotation of Ridge busting pipe lower vertical section 520 may be outside of the pipe being buried and may for example be located on or near Rotating cutter location vertical planes 916.

Pipe burying apparatus 100 may further be outfitted with one or more sensors capable of detecting obstacles such as other pipes in the path of the apparatus and may further be configured to automatically shut down operation of the apparatus.

Pipe burial apparatus described herein may, for example, comprise a first set of rotary nozzle cutters on a first side of a burial pipe; a second set of rotary nozzle cutters on a second side of the burial pipe and a first nozzle array connected to a nozzle supply pipe such that the first set of rotary nozzle cutters and the second set of rotary nozzle cutters straddle the burial pipe; the burial pipe is located at a floor of a body of water; the nozzle supply pipe is located in a cutting path of a rotary nozzle cutter from the first set of rotary nozzle cutters; the nozzle supply pipe is actuated to alternatingly move the first nozzle array between a straddle position that is not below the burial pipe and a cutting position that is below the burial pipe and the first nozzle array is configured to have a travel of at least eight inches upon actuation. In a related example, the first nozzle array may direct spray into a middle third of a space under the burial pipe. In a related example, the first set of rotary nozzle cutters may be attached to a frame, the second set of rotary nozzle cutters may be attached to the frame, the first nozzle array may be attached to the frame and the first nozzle array may be configured to move relative to the frame. In a related example, the first nozzle array may be configured for actuator controlled movement into a position between the first set of rotary nozzle cutters and the second set of rotary nozzle cutters. In a related example, the first nozzle array may extend below an uppermost rotary cutter selected from the first set of rotary nozzle cutters. In a related example, the first set of rotary nozzle cutters may comprise a first rotary nozzle cutter and a second rotary nozzle cutter and the first rotary nozzle cutter may be at a different height than the second rotary nozzle cutter. In a further related example, the first set of rotary nozzle cutters may comprise a first rotary nozzle cutter, a second rotary nozzle cutter and a third rotary nozzle cutter such that the first rotary nozzle cutter is at a different height than the second rotary nozzle cutter; the third rotary nozzle cutter is at a different height than the first rotary nozzle cutter and the third rotary nozzle cutter is at a different height than the second rotary nozzle cutter. In a further related example, the first set of rotary nozzle cutters may be separated from the second set of rotary nozzle cutters by at least 24 inches. In a further related example, the first set of rotary nozzle cutters may be separated from the second set of rotary nozzle cutters by at least 36 inches. In a further related example, the first set of rotary nozzle cutters may be separated from the second set of rotary nozzle cutters by at least one burial pipe diameter. In a further related example, the burial pipe diameter is at least 24 inches. In a further related example, the pipe burial apparatus may further comprise rollers compressed against the burial pipe. In a further related example, the pipe burial apparatus may further comprise actuated rollers compressed against the burial pipe. In a further related example, the pipe burial apparatus may further comprise an eductor configured to remove material from the vicinity of the first set of rotary nozzle cutters. In a further related example, the first nozzle array may be attached to a frame by a ball bearing type high pressure swivel joint and the first nozzle array may be configured to move relative to the frame.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

The invention claimed is:

1. A pipe burial apparatus comprising:

a. a water distribution structure attached to a frame;

b. a first set of rotary nozzle cutters attached to the water distribution structure and configured to rotate with respect to the water distribution structure, wherein the first set of rotary nozzle cutters comprises a first rotary nozzle cutter that is configured to cut along a first cutting plane on a first side of a burial pipe;

c. a second set of rotary nozzle cutters attached to the water distribution structure and configured to rotate with respect to the water distribution structure on a second side of the burial pipe and d. a first nozzle array oriented along a first vertical pipe section of a first offset pipe connected to the water distribution structure by a first ball bearing type high pressure swivel joint such that the first nozzle array may rotate along a semi-cylindrical arc path into a first position;

e. wherein the first set of rotary nozzle cutters and the second set of rotary nozzle cutters are on opposite sides of the burial pipe;

f. wherein the burial pipe is located at a floor of a body of water;

g. wherein the first nozzle array is configured to have a travel of at least eight inches upon actuation;

h. wherein the first vertical pipe section is vertically oriented, the first vertical pipe section is directly below the burial pipe and the first nozzle array is entirely located in a space directly below the burial pipe when the first nozzle array is in the first position and i. wherein the first vertical pipe section lies within the first cutting plane.

2. The pipe burial apparatus of claim 1 wherein the first set of rotary nozzle cutters are attached to the frame, the second set of rotary nozzle cutters are attached to the frame, the first nozzle array is attached to the frame and the first nozzle array is configured to move relative to the frame.

3. The pipe burial apparatus of claim 1 wherein the first nozzle array is configured for actuator controlled movement into a position between the first set of rotary nozzle cutters and the second set of rotary nozzle cutters.

4. The pipe burial apparatus of claim 1 wherein the first nozzle array extends below an uppermost rotary cutter selected from the first set of rotary nozzle cutters.

5. The pipe burial apparatus of claim 1 wherein the first set of rotary nozzle cutters comprises the first rotary nozzle cutter and a second rotary nozzle cutter and the first rotary nozzle cutter is at a different height than the second rotary nozzle cutter.

6. The pipe burial apparatus of claim 1 wherein the first set of rotary nozzle cutters comprises a. the first rotary nozzle cutter, b. a second rotary nozzle cutter and c. a third rotary nozzle cutter;

d. wherein the first rotary nozzle cutter is at a different height than the second rotary nozzle cutter;

e. wherein the third rotary nozzle cutter is at a different height than the first rotary nozzle cutter and f. wherein the third rotary nozzle cutter is at a different height than the second rotary nozzle cutter.

7. The pipe burial apparatus of claim 1 wherein the first set of rotary nozzle cutters is separated from the second set of rotary nozzle cutters by at least 24 inches.

8. The pipe burial apparatus of claim 1 wherein the first set of rotary nozzle cutters is separated from the second set of rotary nozzle cutters by at least 36 inches.

9. The pipe burial apparatus of claim 1 wherein the first set of rotary nozzle cutters is separated from the second set of rotary nozzle cutters by at least one burial pipe diameter.

10. The pipe burial apparatus of claim 1 wherein the burial pipe diameter is at least 24 inches.

11. The pipe burial apparatus of claim 1 further comprising rollers compressed against the burial pipe.

12. The pipe burial apparatus of claim 1 further comprising actuated rollers compressed against the burial pipe.

13. The pipe burial apparatus of claim 1 further comprising an eductor configured to remove material from the vicinity of the first set of rotary nozzle cutters.

* * * * *